United States Patent [19]

Teager

[11] 4,120,346

[45] Oct. 17, 1978

[54] AUTOMATIC CENTRIFUGAL BABBITTING APPARATUS AND METHOD

[75] Inventor: Thomas A. Teager, Natick, Mass.

[73] Assignee: Westinghouse Electric Corp., Pittsburgh, Pa.

[21] Appl. No.: 793,580

[22] Filed: May 4, 1977

[51] Int. Cl.[2] ..... B22D 19/08

[52] U.S. Cl. ..... 164/105; 164/118; 164/157; 164/332

[58] Field of Search ..... 164/4, 105, 118, 114, 164/157, 126, 155, 286, 292, 297, 298, 299, 301, 103, 332; 222/591, 592, 593, 594, 606, 607, 146 C

[56] References Cited

U.S. PATENT DOCUMENTS

| | | | |
|---|---|---|---|
| 1,314,512 | 9/1919 | Dicks | 164/297 |
| 2,745,153 | 5/1956 | Burkett | 222/593 |
| 3,506,060 | 4/1970 | Andrews | 164/118 |
| 3,620,294 | 11/1971 | Hetzel | 164/155 |
| 3,866,661 | 2/1975 | Baumann | 164/114 |

FOREIGN PATENT DOCUMENTS

| | | | |
|---|---|---|---|
| 1,151,357 | 7/1963 | Fed. Rep. of Germany | 222/594 |
| 2,440,967 | 4/1976 | Fed. Rep. of Germany | 164/299 |
| 647,019 | 12/1950 | United Kingdom | 164/157 |

*Primary Examiner*—Francis S. Husar
*Assistant Examiner*—William R. Briggs
*Attorney, Agent, or Firm*—E. C. Arenz

[57] ABSTRACT

The apparatus and method provide an arrangement in which molten babbitt is fed into a spinning cylindrical bearing shell from a stationary molten babbitt tank having a babbitt pump immersed in the tank at an intermediate level, with the pump discharge being connected to piping to discharge molten babbitt into a babbitt trough from which the babbitt feeds to the interior of the spinning shell. The babbitt pump is driven for a controlled time period to feed a specified volume of babbitt into the trough and bearing in a continuous uninterrupted flow so that a carefully metered amount of molten babbitt is fed to the bearing. The apparatus also includes a control system operable to energize and deenergize various operating elements in a sequence including the drive motors, means for admitting a coolant about the hot spinning bearing shell, and the molten babbitt pump.

6 Claims, 3 Drawing Figures

AUTOMATIC CENTRIFUGAL BABBITTING APPARATUS AND METHOD

BACKGROUND OF THE INVENTION

1. Field of the Invention

The invention pertains to apparatus and a method for centrifugally casting a babbitting material to a cylindrical bearing shell.

2. Description of the Prior Art

It is known in the commercial prior art to provide a centrifugal casting or babbitting machine in which the cylindrical bearing shell is mounted between opposite end plates on a structure similar to a lathe bed with a fixed headstock having a rotatable plate, and a movable, clamping tailstock plate. The prior art commercial device also includes what may be called a runner trough into which molten babbitt is ladled and from which the molten babbitt passes into the interior of the bearing shell through a conduit extending through the idling end plate. The arrangement known to me as being commercially available also includes a gas heater arrangement for applying heat to the runner trough to prevent the molten babbitt from solidifying in the runner trough. The particular commercial machine of which I am aware also includes an arrangement for spraying cooling water into the space around the bearing shell after the molten babbitt has been applied to the trough and bearing shell.

In another commercially used arrangement of which I am aware a gas-fired heated babbitt tank is located in spaced-apart relation from the idler end plate of the machine and a removable pipe connects the lower end of the tank with the interior of the babbitt shell. A valve on the tank is manually opened for a predetermined time to meter the quantity of babbitt desired for the particular bearing. This arrangement, used for relatively large bearing shells, includes an arrangement for lowering the molten babbitt tank to facilitate loading the tank with the solid babbitt material to be melted, the tank then being elevated to an operating position.

Neither of these arrangements are considered to be wholly satisfactory in my estimation for a number of reasons. First, the manual operations of handling torches for maintaining certain parts at adequate temperatures and the manual ladling of molten metal, introduces problems of safety. The operation of ladling or in any other way of feeding babbitt in other than a continuous pour can frequently result in an inferior bond of the babbitt to the bearing and the presence of porous and laminated layers of babbitting. I attribute such undersirable results as stemming from the intermittent pouring as well as the inexact control of process temperatures, spinning speeds, cooling and pouring times. Another disadvantage of commercially used casting apparatus is that due to the lack of precise pouring controls, excess babbitt is often poured into the casting. As a result of the excess babbitt, increased costs are encountered in the additional machining required as well as the recycling cost for the excess babbitt.

For these and other reasons it is my view that the production level under the prior art arrangements is relatively low compared to what is available from an arrangement in accordance with my invention, and that the rate of rejection with an arrangement according to the invention is substantially reduced.

Accordingly, the aim of my invention is to provide an apparatus and method for centrifugally casting babbitt in which the disadvantages of the prior art commercial arrangements are substantially avoided.

SUMMARY OF THE INVENTION

In accordance with my invention, the apparatus includes spaced apart end-plates between which the cylindrical bearing shell is received, with these end-plates being within an openable housing means which generally encloses the space in which the bearing shell is received. Means are provided for driving the idler end plate between positions in which the bearing shell is clamped and in which it is released. The assembly with which the idler end plate is associated carries an inclined trough and conduit means which connect the lower end of the trough with the interior space of the bearing shell when it is in position for babbitting. A stationary, molten babbitt tank is located adjacent the idler end plate assembly, with a molten babbitt pump being immersed in the tank at an intermediate level. An electric motor is mounted above the tank and connected to drive the pump, and pipe means are connected to the discharge of the pump and extend to a pipe outlet located to overlie the open top side of the trough throughout the range of movement of the trough in its positioning in accordance with the length of a particular bearing shell. The apparatus also includes means for heating the babbitt tank, means for electrically heating and maintaining trough temperature, means for admitting a coolant into the space in the housing about the bearing shell, means for rotating the driven end plate at a predetermined speed in accordance with the size of a particular bearing being babbitted, and means for energizing the electric motor for the pump for a controlled time to feed a specified volume of babbitt into the trough and into the bearing interior in a continuous, uninterrupted flow.

Also in accordance with the arrangement, means are provided for cooling the electric motor for the molten babbitt pump and its bearings, and a control system is provided including switch means and timer means which energize and deenergize the rotating means for the driven end plate, the coolant admission means and the molten babbitt pump in a predetermined sequence of first energizing the rotating means, then the coolant means and then the babbitt pump, and then deenergizing first the babbitt pump, and thereafter the coolant means and the end plate rotating means. The arrangement also includes means responsive to the temperature of the molten babbitt below a predetermined temperature level to prevent the operation of the babbitt pump motor.

Other preferred features will also be described in the description which follows.

DRAWING DESCRIPTION

DESCRIPTION OF THE PREFERRED EMBODIMENT

Figure 1:
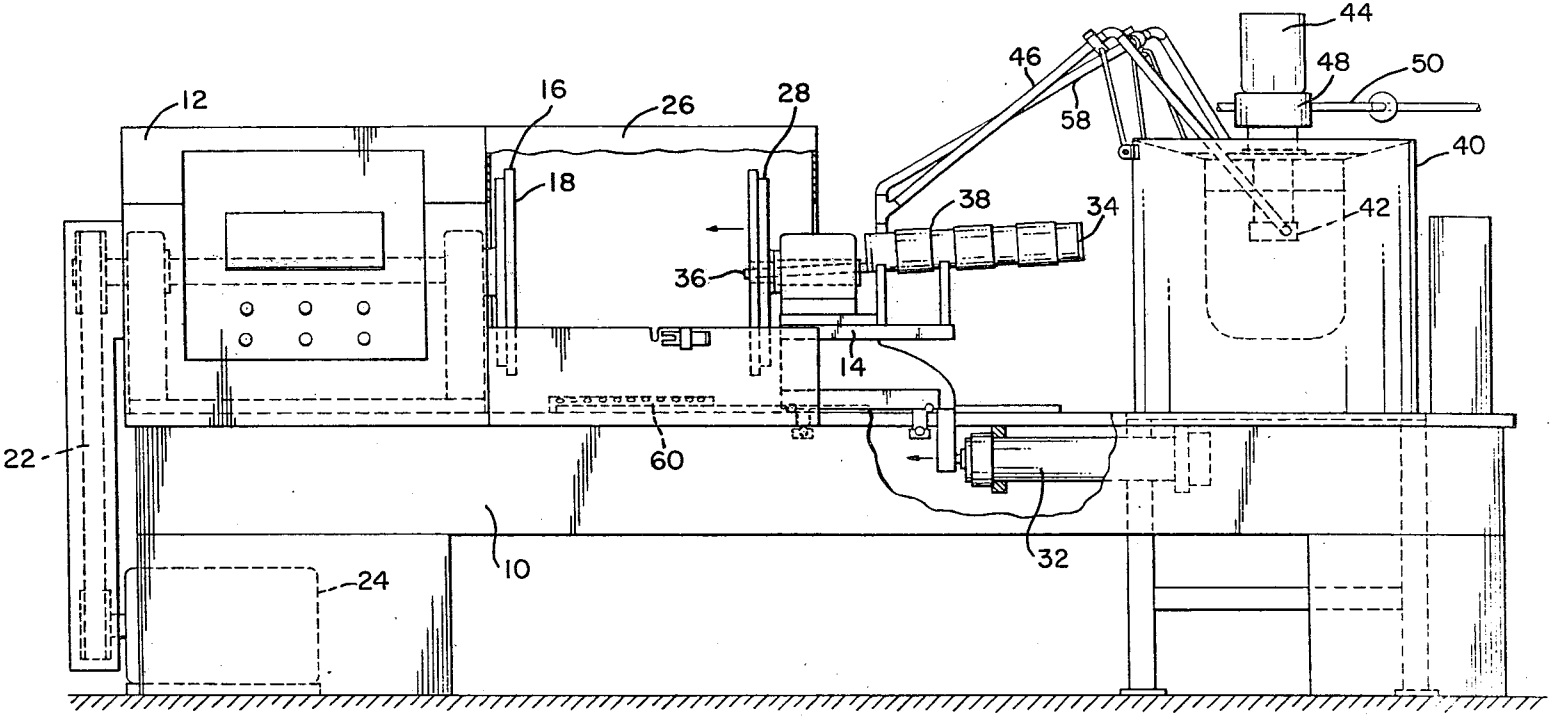
FIG. 1 is a partly diagrammatic front elevation view of apparatus according to the invention.
Figure 2:
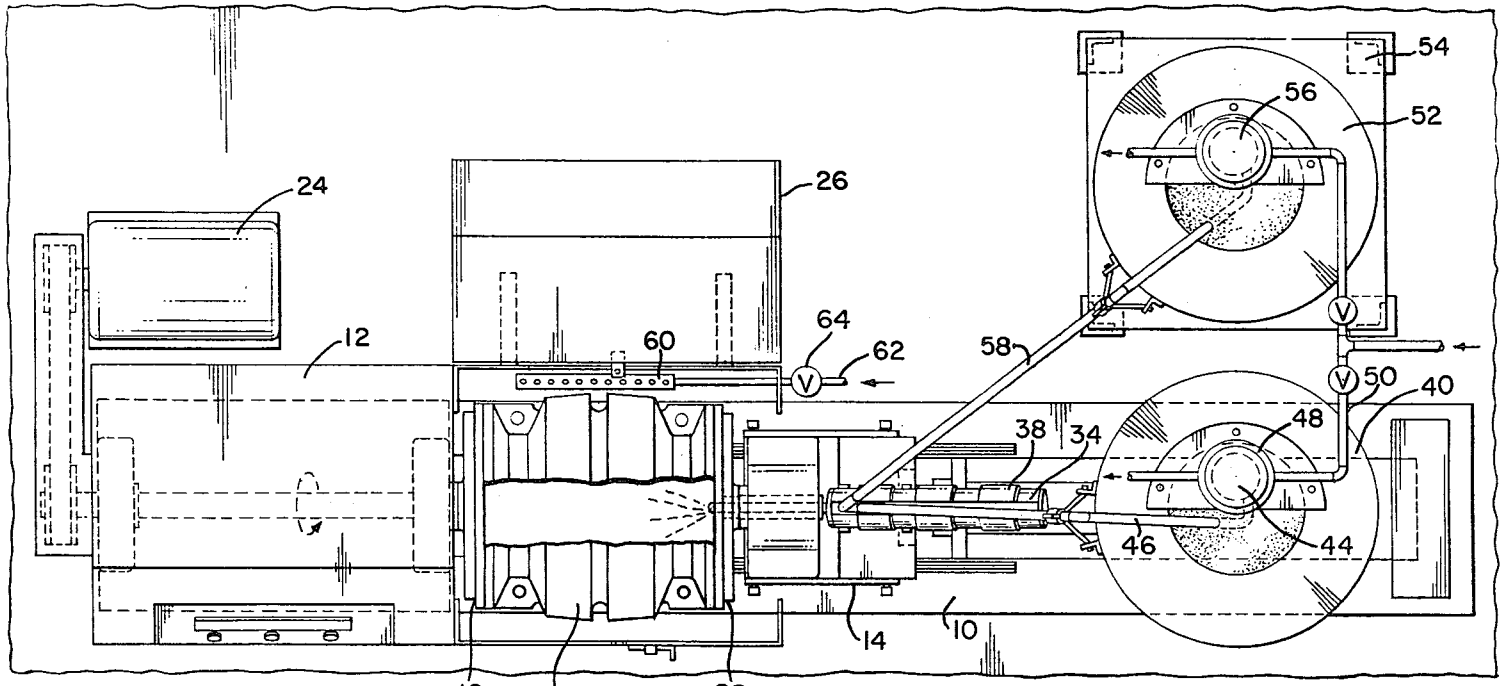
FIG. 2 is a top view, again partly diagrammatic, of the apparatus according to the invention.

The apparatus according to the invention as seen in FIGS. 1 and 2 includes a base frame 10 which is similar in form to a lathe bed including a stationary headstock section 12 and a movable, clamping tailstock section 14. The headstock section includes a first rotatable end plate 16 which includes a sealing face 18 thereon against which the outer marginal portion of one open end of a cylindrical bearing shell 20 is received and sealed. The first end plate is driven through a belt drive 22 by a motor 24 which may be a DC motor coupled with an SCR drive to provide an arrangement in which a relatively wide speed range is attainable to permit selecting the proper casting speed for any size bearing which the machine can handle.

An openable, hood-shaped cover 26, shown broken away in FIG. 1 and open in FIG. 2, overlies the space in which the bearing shell 20 is received between the end plates and thus serves along with the underlying structure to generally enclose that space so that a coolant such as water mist may be sprayed or circulated in that space at the appropriate time.

The second or opposite end plate 28 of the tailstock section is an idler end plate which also has a sealing face 30 thereon for receiving the outer marginal portion of the other open end of the bearing shell and sealing it. To drive the second or idler end plate assembly of the tailstock section toward and away from the first end plate, an air-hydraulic cylinder arrangement 32 is provided in the base frame of the unit and is connected to drive the end plate assembly to the left and right to clamp and release, respectively, the bearing shell.

The movable end plate assembly also includes means supporting an upwardly-open, inclined, babbitt receiving trough 34, the lower bottom end of the trough being connected by a conduit 36 to pass to the interior space of the bearing shell the molten babbitt received by the trough. Several electric mica heater elements are applied to the outside wall of the trough 34 and then are covered with thermal insulation 38, the top of the trough being open as seen in FIG. 2.

A molten babbitt tank 40 is stationarily mounted upon the frame 10 at the end of the apparatus adjacent the movable end plate assembly and molten babbitt trough. The tank is electrically heated and is provided with thermal insulation so that the babbitt therein can be maintained at least at a given temperature for the particular babbitt material in the tank. A centrifugal pump 42 is immersed at an intermediate level in the tank and is adapted to be driven by an electric motor 44 mounted above the tank. An angle-shaped pipe 46 has one portion of its length immersed in the tank with its end connected to the discharge of the pump, and extends with its other portion to its outlet at a location overlying the open top side of the trough 34. At least that portion of its length extending from the angle to its open end over the trough is wrapped with thermal insulation. The length of the open slot of the trough 34 is dimensioned such, relative to the location of the outlet of the pipe 46, that within the range of movement of the movable end plate in accordance with the length of the particular bearing which is to be babbitted, the open end of the pipe 46 will always overlie the slot.

A water jacket 48 is provided adjacent the lower end of the motor 44 and in the vicinity of the motor bearings to prevent overheating of the motor and bearings from the molten babbitt in the tank. The water jacket is fed by piping 50.

A second stationary tank 52 for molten babbitt is stationarily mounted on a platform 54 adjacent the first tank. This second tank is identical in its general character to the first tank and accordingly includes an immersed pump (not shown) and a motor 56 and water jacket, etc.

In the particular embodiment forming the basis for the description herein, the one tank is provided with babbitt having a lead base and the other tank is provided with babbitt having a tin base. Because of the difference in the base of the babbitt in the two different tanks, the two different tanks are maintained at different temperatures. For all sizes of bearings, the tin base babbitt is maintained at a temperature of about 850° F. (454° C.), while the temperature of the lead base babbitt is maintained in range of about 725° F. to 775° F. (385° to 413° C.) for the different sizes and different types of bearing shells which are to be babbitted.

It is considered important that the pump in each tank be located at an intermediate level in which contamination from both surface dross and "bottom of the pot" impurities is minimized.

The piping 46 and 58 which leads from the pumps in the two tanks is preferably provided with a thermal insulation blanket around the pipes to aid in maintaining the heat content of the babbitt as it flows to the heated trough 34. It has been found convenient in the embodiment illustrated to join the pipes at a location immediately above the top open slot of the trough so that a single outlet is provided regardless of the type of babbitt used. A siphon break (not illustrated) is included in the piping 46 and 58 to insure a positive cutoff of babbitt flow when the pump 42 is shut off.

The apparatus also includes means for circulating a coolant about the bearing shell 20 in the housing at the appropriate time. In the illustrated embodiment this arrangement includes a water spray pipe 60 in the lower part of the space in which the bearing shell 20 is mounted for rotation, and a water supply pipe 62 having a solenoid operated valve 64 therein is provided to control the flow.

Figure 3:
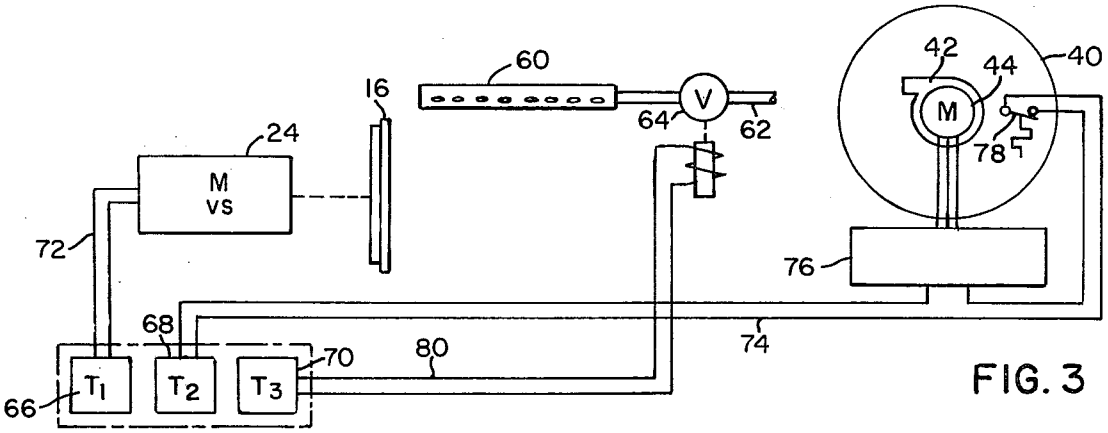
FIG. 3 is a partly schematic, partly diagrammatic view of the major parts of the control system for the apparatus.

The main parts of the control system are illustrated in the diagrammatic layout of FIG. 3. The system includes three programmable timers 66, 68 and 70 containing switch means and controlling the "On-Off" cycle times of the main drive motor 24, the molten babbitt pump 44, and the cooling spray solenoid valve 64, respectively. For automatic operation, these timers are set for specific time periods in accordance with a schedule developed in accordance with bearing size and types. The timer 66 is connected by the line 72 to an AC-DC adjustable speed drive which controls the application of power to the motor 24. Also associated with the drive motor and its circuitry is a speed control rheostat and indicator, which are not shown. Other safety and convenience elements not shown include an air switch and a housing covered limit switch in the circuitry to the timer means which prevent certain operations if the cover is not closed at the proper time and if the air pressure for the air-oil clamping cylinder 32 (FIG. 1) is below a safe clamping pressure.

The control lines 74 from the pump timer 68 to the magnetic starter 76 for the pump also include a thermostatic switch 78 in one of the lines, this switch reflecting the molten babbitt temperature and being in an open position if the temperature of the babbitt is below a predetermined level, so that operation of the babbitt pump is then precluded.

The control lines 80 connect the third timer 70 to the solenoid valve 64 which controls the admission of spray cooling water into the sprayer 60.

The controls for the heater for the trough 34, and for the babbitt melting tanks are straightforward and accordingly are not shown in FIG. 3. For the convenience of the operator of the machine, the temperatures of the trough and of the melting pots are indicated by visual means (not shown) to prevent an operation which would be aborted by the thermal switch 78 being open due to insufficient temperature. Further, the operator is given instructions about energizing the melting pot heaters and the trough heaters at predetermined times prior to operating the apparatus. Also, whenever the melting pots are on or cooling down the water lines to the pump motors 44 and 56 are open to allow water to flow through the water jacket.

For operating the apparatus, the operator goes through a start-up and operation sequence which basically proceeds as follows. The melting pot and trough heater temperatures are checked in accordance with the charts provided to the operator. The water flow through the water jackets for the pump motors is checked. The air pressure for the air cylinder 32 is checked to see whether it is adequate. Each of the timers 66–70 is set to the proper "On-Off" times as indicated on the operator's chart. The switches which control whether the apparatus is to operate in an automatic fashion or whether individual elements are to be run manually for checking are placed in the automatic position. The housing cover 26 is closed so that the main drive motor can be tested in a manual position and the proper speed set up. Then the switch for the main drive motor is switched back to the automatic position. Then the cover is again opened and the opening between the end plates 16 and 28 is adjusted so that the particular length of bearing to be babbitted will set between them.

The basic steps in preparing a bearing shell for the actual babbitting operation will be briefly outlined. The bearing shells 20, which comprise two longitudinally split parts, are assembled and fluxed and then tinned in flux and tin tanks. The tin tank is maintained at temperatures well above the proper temperature for the casting to have when it is going to be babbitted, and the bearing shell is allowed to remain in the tin tanks for a period which permits it to reach a temperature sufficiently above its proper temperature for babbitting that the additional operations can be carried out on the shell without it cooling below the specified temperature before the babbitting.

Once the bearing has been properly tinned, aluminum shims are inserted between the mating halves of the shell and the bolts holding the two parts together snugged up. The bearing shell is then moved to the apparatus and is lowered into place to line up with the sealing face 18 on the first end plate 16. The clamping cylinder 32 is then actuated to move the opposite end plate 28 to the left into a position in which it clamps the bearing shell, in properly aligned and seated relation, between the two end plates. The clamp control is then switched to a stop position, the bolts of the bearing shell are tightened, and the chain and eye hook which has been used for manipulating the heavy bearing shell is then removed. The clamp switch is then placed back in the clamped position.

The temperature of the bearing shell 20 is then checked to see whether it is at the specified temperature. If it is too hot, it is permitted to cool until it reaches the proper temperature range. If it should occur that the temperature of the bearing is too cold at this time, the shims must be removed and the bearing shell reheated. If the bearing shell is within the proper temperature range, the cover 26 is closed and locked and a starting switch is pushed for the automatic operation.

The sequence which occurs with the automatic operation of the control system results in energizing in a predetermined sequence and for preselected times, first the motor 24 driving the first end plate, then the coolant circulating means accomplished through opening the solenoid valve 64, and then the molten babbitt pump motor 44 or 56, depending upon which tank is being used. After energizing in that sequence, the sequence of deenergizing these elements include first deenergizing the babbitt pump, after a relatively short run, and after a considerably longer period thereafter the coolant circulating means, and finally the main drive motor for the driven end plate.

I find it desirable to begin the spray cooling before the molten babbitt pump is energized, and generally start the cooling about 6 seconds before the babbitt pump is energized. The molten babbitt pump is energized for only a short time (the exact time of cource being dependent upon the size and capacity of the pump) but I maintain the coolant flow until very shortly before the main drive motor 24 is deenergized. It is considered desirable that the coolant start prior to the flow of the molten babbitt so that there is a tendency for the bearing shell to cool in a direction of from outside inwardly. This is believed to be useful to maintain a good bond between the babbitt and the shell, and this also minimizes leakage of the babbitt in an outward direction as the shell is being spun. The main drive motor speeds are determined in accordance with the diameter size of the bearing, and as example, will vary with the inverse square root of the radius, thereby maintaining a constant centrifugal force for casting of the babbitt metal. It is also generally preferred that for larger bearings the temperature of the casting or shell be higher than for the smaller bearings before the operation takes place, due to the larger mass of the bearing, although in the case of bearings of certain character and of a limited size range it may be permissible to have the casting temperature at the same level regardless of the size.

It is believed deserving of emphasis that the benefits noted hereinbefore derive from the automatic cycle carried out in which close control of critical variables is maintained. One of the more important elements of the apparatus yielding control of a critical variable is the use of the immersed molten babbitt pump which is energized for a specific time and produces a continuous uninterrupted flow of the babbitt to yield a relatively precise quantity of babbitt at the proper temperature. With the pump immersed to an intermediate location, both floating dross and bottom of the pot impurities are excluded from the pumped flow. By providing a fixed length of pipe with a siphon break leading from the pump to the trough, the resistance to babbitt flow remains fixed. This fixed parameter, coupled with the uniform head on the pump permits the use of a relatively inexpensive centrifugal pump of a type lending itself to the motor and bearing cooling arrangement, instead of being required to use a very expensive positive displacement pump. The automatic cycle also derives the benefit of maintaining all temperature variables involved in the centrifugal casting of babbitt, and once set, achieve a repetitiveness not before possible.

I claim:

1. Apparatus for applying babbitting material to a cylindrical bearing shell, comprising:

a first rotatable end plate including a sealing face thereon against which the outer marginal portion of one open end of said bearing shell is received and sealed;

a spaced apart, opposite end plate assembly including a rotatable end plate having a sealing face thereon against which the outer marginal portion of the other open end of said bearing is received and sealed;

openable housing means generally enclosing the space in which the bearing shell is received between said plates for babbitting;

means moving said opposite end plate assembly between one position clamping said shell between said end plates in a sealing relation, and other positions for releasing said shell after babbitting;

an upwardly-open, inclined babbitt-receiving trough carried by said opposite end plate assembly and including conduit means connecting the lower end of said trough to a location between said end plates and corresponding to the interior space of a bearing shell when the shell is in position for babbitting;

a stationary, molten babbitt tank adjacent said opposite end plate assembly;

a molten babbitt pump immersed in said tank at an intermediate level;

an electric motor mounted above said tank and connected to drive said pump;

pipe means connected to the discharge of said pump and extending to a pipe outlet located to overlie the open top side of said trough throughout the range of movement of said trough in its positioning in accordance with the length of a particular bearing shell;

means heating said babbitt tank;

means admitting a coolant into said housing for circulation about said bearing shell;

means rotating said first end plate at a predetermined speed in accordance with the size of a particular bearing;

means energizing said pump electric motor for a controlled time to feed a specified volume of babbitt into said trough in a continuous uninterrupted flow; and a control system including switch means and timer means actuating and deactuating in a predetermined sequence and for preselected times the rotating means for the first end plate, the coolant circulating means, and the molten babbitt pump motor;

said predetermined sequence including first actuating said end plate rotating means, then said coolant admission means, and then said molten babbitt pump motor, and then deactuating first said molten babbitt pump motor and thereafter said coolant circulating means, and said end plate rotating means.

2. Apparatus according to claim 1 including:

means cooling said pump electric motor and its bearings.

3. Apparatus according to claim 1 including:

a second, stationary, molten babbitt tank containing a babbitt material different from that in said first tank, adjacent said first tank and said opposite end plate assembly;

said second tank having the same arrangement of a babbitt pump, electric motor means, pipe means, and tank heating means, as set forth for said first molten babbitt tank.

4. Apparatus according to the claim 1 wherein said control system includes:

means responsive to a temperature of said molten babbitt below a predetermined temperature for preventing operation of said babbitt pump motor means.

5. Apparatus according to claim 1 including:

electrical resistance heater means associated with said trough.

6. In the method of babbitting a cylindrical bearing shell which is spun while molten babbitt is applied to it interiorly, comprising:

heating the shell to a proper temperature range and then, in a predetermined time-controlled, automatic sequence, beginning while the shell is still in the proper temperature range, spinning said shell, applying cooling to the exterior of said shell before beginning the application of babbit, and then pumping an uninterrupted, continuous flow of molten babbitt with a pump from an intermediate location in a molten babbitt tank to the interior of the shell for a short period of time relative to the overall time of spinning and the continued application of cooling, both of which continues while said babbitt is being pumped and thereafter for a relatively long period of time, the application of cooling before pumping and the continued application of cooling yielding a direction of cooling of the shell from outside inwardly.

* * * * *